United States Patent [19]

Föhl

[11] 4,335,491

[45] Jun. 22, 1982

[54] BELT-LOCK FOR A SAFETY BELT

[75] Inventor: Artur Föhl, Schorndorf, Fed. Rep. of Germany

[73] Assignee: Repa Feinstanzwerk GmbH, Alfdorf, Fed. Rep. of Germany

[21] Appl. No.: 157,955

[22] Filed: Jun. 9, 1980

[30] Foreign Application Priority Data

Jun. 8, 1979 [DE] Fed. Rep. of Germany ..... 2923352

[51] Int. Cl.[3] ..... A44B 11/26

[52] U.S. Cl. ..... 24/230 A; 24/230 R; 267/182

[58] Field of Search ..... 24/230 A, 230 BC, 230 AL, 24/230 R; 267/182

[56] References Cited

U.S. PATENT DOCUMENTS 3,623,191 11/1971 Hayashi ..... 24/230 A 4,015,094 3/1977 Gavagan et al. ..... 24/230 A

*Primary Examiner*—Alexander Grosz

*Attorney, Agent, or Firm*—Herbert L. Lerner; Laurence A. Greenberg

[57] ABSTRACT

Belt-lock and plug-in tongue for safety belt having movable spring loaded latch and slideable member to move latch out of engagement by pressing push button. A wire spring is disposed in the push button with a bent portion of the spring banked at the lock housing to effect counter-action for the pressure against the push button and a free, bent-spring ending abutting against the slide member to keep it fixed and prevent rattling. The spring arrangement also relieves pressure on the sliding member when the push button is pressed.

3 Claims, 4 Drawing Figures

BELT-LOCK FOR A SAFETY BELT

BACKGROUND OF THE INVENTION

1. Field of the Invention

The invention relates to a belt-lock for a safety belt in which a tongue is inserted into the lock-housing.

2. Description of the Prior Art

Belt-locks for a safety belt in which a tongue can be plugged into a plug-in passageway in the housing of the lock, and which can be locked by a movable spring-loaded latch are known. In order to move the latch to the open position, a slide member which slides in a guide in the lock-housing is provided. The slide member is activated by a pushbutton that can be pressed into the lock-housing against the force of a spring.

When the pushbutton which, for example, can be constructed in the form of a one-armed lever, is pressed-in, the slide member supported in the housing of the lock and slideable longitudinally, is displaced, similar to a sliding gear over a sloped guide. This slide-member, in turn, resets the latch, which is engaged with the plug-in tongue, to the open position, so that the tongue and the belt-lock can be separated from each other. For this purpose, in conventional manner, a springy ejector in the plug-in path of the lock-housing, pushes the plug-in tongue out of the plug-in path when the latch moves to the open position. Usually, the belt-lock is fastened to the chassis of the motor vehicle. The plug-in tongue is fastened to the free end of a safety belt, which belt can be rolled in or out of an automatic roll-up device. In such accessories for motor vehicles, one generally tries to construct and support the various structural members to avoid an annoying rattle when the car is in motion. This condition is fulfilled with certain individual parts of such a belt-lock, because these parts, for example, the ejector, the push-button and the latch, are always under spring pressure. A problem with respect to annoying rattle arises only with the slide-member which moves longitudinally in the lock housing and for which, functionwise, there is no pressure spring. If one wants to avoid the additional costs for arranging a special pressure spring for holding the slide member, or wants to avoid the cost-intensive precise fitted support of the slide-member, one must accept the fact that the slide-member rattles when the vehicle moves over uneven roads, due to the relatively loose guide-fit of the slide-member. This rattle will occur whether or not the passenger uses the safety belt.

SUMMARY OF THE INVENTION

An object of the present invention is to provide a belt-lock of the mentioned type in which the slide-member is fixed in the belt-lock without construction complexity in such manner that it is rattle-free.

With the foregoing and other objects in view, there is provided in accordance with the invention a belt-lock and plug-in tongue for a safety belt comprising a lock-housing having a plug-in opening for insertion of a plug-in tongue, a movable spring-loaded latch disposed in said opening in the path of said plug-in tongue effecting locking of the inserted tongue, a slide member slideable in a guide in the lock-housing to move said latch out of engagement with said tongue to permit separation of the tongue from the belt-lock, a push-button mounted on the housing over the slide-member with pressure on the push-button activating the slide-member to slide and move the latch out of engagement with the tongue, a spring made of spring-wire disposed in the push-button with a bent portion of the spring banked at the lock-housing to effect an elastic, springy counteraction against pressure for the push button, and with the spring having a free, bent-spring ending abutting elastically against the slide member.

Other features which are considered as characteristic for the invention are set forth in the appended claims.

Although the invention is illustrated and described herein as embodied in a belt-lock for a safety belt, it is nevertheless not intended to be limited to the details shown, since various modifications may be made therein without departing from the spirit of the invention and within the scope and range of equivalents of the claims.

BRIEF DESCRIPTION OF THE DRAWINGS

The construction and method of operation of the invention however, together with additional objects and advantages thereof will be best understood from the following description when read in connection with the accompanying drawings, in which.

DETAILED DESCRIPTION OF THE INVENTION

Figure 1:
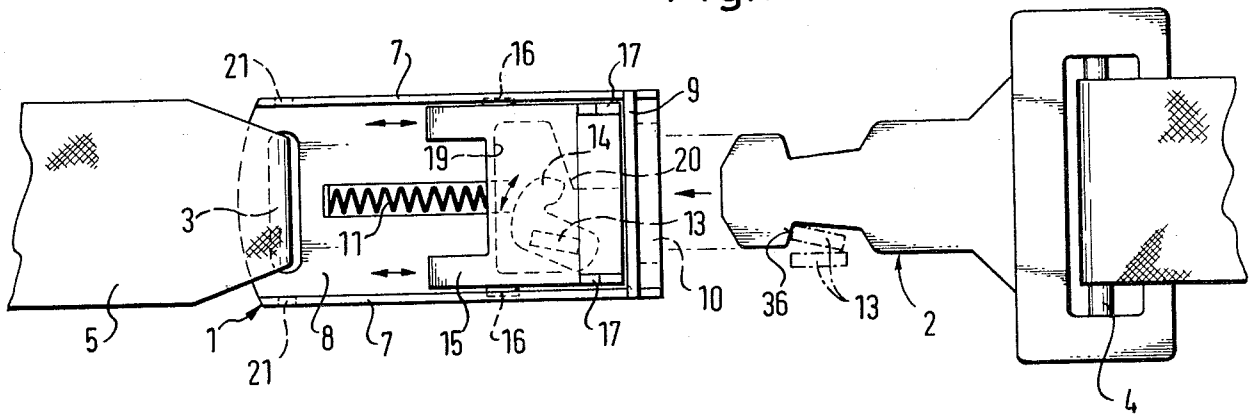
FIG. 1 is a plan view of the belt-lock and plug-in tongue in partial assembly but showing the latch for locking the inserted tongue and the sliding member for moving the latch out of engagement with the tongue.

The spring which is made of spring wire and disposed in the push button, banks with a bent portion at the lock-housing, and abuts with a free, bent-spring-ending elastically against the slide-member. Thus, the mentioned spring has two functions. It serves, in the conventional manner as an elastic, springy counter-support for the push-button, and also effects rattle-free fixation of the slide-member in all imaginable operational positions of the belt lock, or of the safety system in action. The cost for such a spring having a free, bent-spring-ending is negligably higher than for a spring without a double function. The same applies to the installation of this spring. Also the assembly cost is not higher than the assembly cost for a conventional belt-lock.

A further advantage of the invention is achieved by constructing the spring in such a manner that the essentially U-shaped spring has, at one free leg, a portion which is preferably bent like a spring loop and is in contact with a sloped support surface of the lock-housing. Thus, at the other free leg, the spring-ending which abuts against the slide-member, rotates together with the rotation of the mentioned portion, and the torsion of the constrained leg. Therefore, the spring functions like a torsion spring whereby the two free legs are connected by the constrained leg in such a manner that a rotation of one leg causes a rotation of the other free leg in the same directional sense. This circumstance is advantageously utilized so that the force of the spring-ending which acts on the slide-member never gets greater, but is reduced when the push-button is pressed down, i.e. is operated, so that the motion of the slide member is not obstructed or inhibited.

An improvement of the belt-lock according to the invention with respect to the installation of the above described spring and with respect to the total cost of the belt-lock is achieved by providing lateral, hollow spaces on the bottom side of the push-button in which spaces the constrained leg, and a bend support-ending of the leg with the spring portion are supported and secured.

In the following the invention is explained with the aid of a typical embodiment shown in the drawings.

Figure 2:
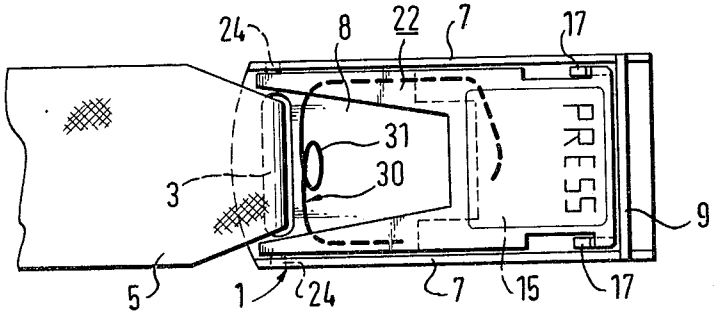
FIG. 2 is a plan view in a more advanced state of assembly additionally showing a push-button with a wire spring disposed in the button having a spring loop banked at the lock-housing and a free bent-spring ending abutting elastically against the slide-member.
Figure 4:
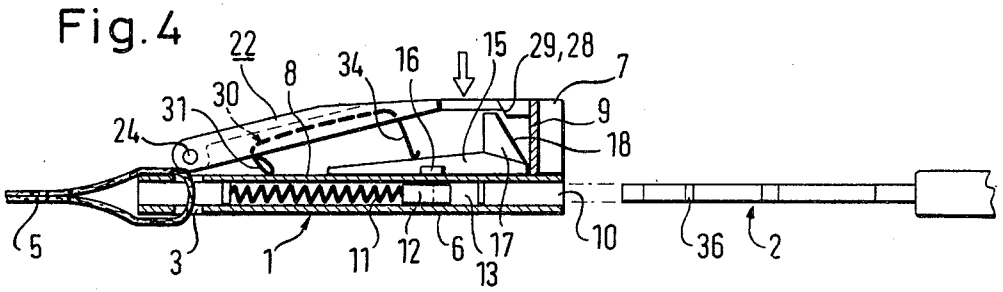
FIG. 4 is a sectional side view of the belt-lock schematically showing the relationship of the lock-housing, tongue, spring ejector, latch, sliding member, and push-button and spring.

Referring to FIGS. 1, 2 and 4, a metallic lock-housing is designated by numeral 1 and a lock push-in tongue by 2. Safety-belt parts are fastened in the opening 3 of the lock-housing 1 and opening 4 of the push-in tongue 2. For example, the belt part 5 fastened to the lock-housing 1 can be secured to the bottom of the motor vehicle, while the belt part which is fastened to the plug-in tongue 2 at 4 can be rolled in or out by an automatic belt take-up roller, not shown, which latter is fastened to the frame of the vehicle. The belt from the take-up roller may be conducted over a deflection fitting. The lock-housing 1 consists essentially of a base plate 6 having in U-form bent-up side cheeks 7 on both sides, an intermediate plate 8 which is parallel to the base plate 6, and also a front plate 9. Base plate 6 and the intermediate plate 8 form the boundary of the plug-in path 10 for the plug-in tongue 2 whereby a slideable ejector 12 which is actuated by a spring 11 is disposed in said plug-in path. A metallic, rectangular-shaped latch 13 is pivotably supported in the base and intermediate plates 6 and 8 in holes which are not shown, whereby the latch 13 is provided above the intermediate plate 8 with a control-catch 14 which, for example, can be made of plastic. A sliding member 15, for example, made of plastic, is supported on the intermediate plate 8, slideable in the direction of the double arrow. The sliding member is provided with two guide lugs 16 on opposite edges, by which it is loosely guided in corresponding guide-slots in the side-cheeks 7 of the lock-housing 1. Furthermore, the sliding member 15 is provided at the height of its boundary edges with two control latches 17 with sloping control surfaces 18. The sliding member has also a recess 19 on the side adjacent to the intermediate plate 8, said recess having a pressure edge 20 for contact with the control catch 14 of the latch 13.

Figure 3:
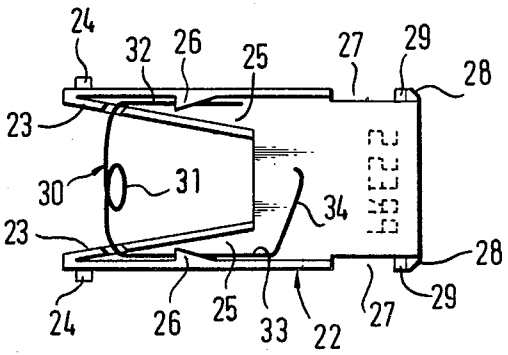
FIG. 3 is a bottom view of the push-button with its spring as shown in FIG. 2.

A push-button 22 made of a synthetic material, shown in detail in FIG. 3, is in the form of a one-armed lever hingeably connected with the lock-housing 1 in support openings 21. The essentially U-shaped push-button 22 has two bearing legs 23 with gearing pins 24 which can be snapped into the bearing holes 21. In the region of the bearing legs 23 are hollow spaces 25. At the sides of the hollow spaces 25 are plastically deformable holding lugs 26. Furthermore, the push-button 22 is provided with two recesses 27 at its sides which permit the sliding motion of the control latches 17 of the sliding member 15. Adjacent thereto the push-button 22 has on both sides control protrusions 28 with sloped control surfaces 29. A spring made of spring wire, generally designated by numeral 30, essentially is U-shaped, having at its free leg an elastic portion 31 shaped as a spring loop, with an adjacent bend support end 32 on one side, and with a constrained connecting leg at the other side, having a free, bent-spring ending 34. The legs 32 and 33 are guided in the hollow spaces 25, and secured by means of the holding lugs 26. As shown in FIGS. 3 and 4, the portion 31 is braced with a slant against the intermediate plate 8 of the lock-housing 1 which serves as the counter-support for the spring 30. Similarly the spring ending 34 banks elastically on the sloped upper surface of the sliding member 15. This spring has a double function. On the one hand it serves as an elastic, springy abutment for the push-button 22, and on the other hand it serves to hold the loosely guided slide-member 15 elastically and without rattle.

A more detailed functioning of the disclosed belt-lock will be explained in the following:

When the plug-in tongue 2 is inserted into the plug-in path 10 of the lock-housing 1 the spring-loaded latch 13—the means for spring loading are not shown—snaps automatically behind a locking edge 36 of the plug-in tongue 2 as is shown in FIG. 1 by dash-dotted lines. The ejector 12 is thereby tensioned. All individual parts of the belt-lock are now in a spring-loaded position without rattle. As explained previously, the slide-member 15 is also secured elastically and without rattle by the free spring ending 34 of the spring 30. Now if the plug-in tongue 2 is to be released, the push-button 22 is pressed in the direction of the arrow shown in FIG. 4. Thereby, the control surfaces 29 of the control protrusions 28 glide on the control surfaces 18 of the control latches 17 of the slide-member 15, causing the slide-member 15 to move in the direction to the bearing pins 24. At the same time the pressure edge 20 of the slide member 15 moves against the control catch 14 of the latch 13, and thereby moves the latch 13 out of the plug-in path 10, with the result that the plug-in tongue 2 is ejected from the plug-in path 10 of lock-housing 1 by the ejector 12 motivated by spring 11. While the push-button 22 is pressed-in, the spring portion 31 of spring 30 is twisted. This turning motion causes torsional stress in the constrained spring leg 33, whereby this torsional motion effects a hinge-motion of the free, bend spring end 34. This means that with the pressing of the push-button 22 the load is removed from the free spring ending 34 which acts on the slide member 15, so that the sliding motion of the slide member 15 is not interfered with in any manner. After release of the push-button 22, the free spring ending 34 presses again with the same force as before on the slide member 15 and secures the latter.

I claim:

1. Belt-lock and plug-in tongue for a safety belt comprising a lock-housing having a plug-in opening for insertion of a plug-in tongue, a movable spring-loaded latch disposed in said opening in the path of said plug-in tongue effecting locking of the inserted tongue, a slide member slideable in a guide in the lock-housing to move said latch out of engagement with said tongue to permit separation of the tongue from the belt-lock, a push-button mounted on the housing over the slide-member with pressure on the push-button activating the slide-member to slide and move the latch out of engagement with the tongue, a spring made of spring-wire disposed in the push-button with a bent portion of the spring banked at the lock-housing to effect an elastic, springy counter-action against pressure for the push button, and with the spring having a free, bent-spring ending abutting elastically against the slide member.

2. Belt-lock according to claim 1, wherein the spring is essentially U-shaped with the bent portion in form of a spring loop, wherein a portion of the wire which precedes the spring ending is constrained in the push button, and wherein the spring ending which abuts against the slide-member rotates together with the rotation of the spring loop and the torsion of the wire which is constrained which precedes the spring ending.

3. Belt-lock according to claim 2, wherein at the bottom side of the push button are lateral hollow spaces in which said constrained wire, and also a bent support end extending from the spring portion are supported and secured.

* * * * *